US012297713B2

(12) United States Patent
Flander et al.

(10) Patent No.: US 12,297,713 B2
(45) Date of Patent: May 13, 2025

(54) PRESSURE MODULATING MULTI-DIAMETER THRUST CUP ARRANGEMENT AND POSITIONING SYSTEM

(71) Applicant: Schlumberger Technology Corporation, Sugar Land, TX (US)

(72) Inventors: Simon Mattias Flander, Houston, TX (US); Julien Toniolo, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 18/353,662

(22) Filed: Jul. 17, 2023

(65) Prior Publication Data

US 2023/0366288 A1 Nov. 16, 2023

Related U.S. Application Data

(63) Continuation-in-part of application No. 17/814,941, filed on Jul. 26, 2022, now abandoned, which is a continuation of application No. 17/101,965, filed on Nov. 23, 2020, now Pat. No. 11,434,701.

(51) Int. Cl.

| | |
|---|---|
| ***E21B 33/12*** | (2006.01) |
| ***E21B 17/10*** | (2006.01) |
| ***E21B 23/10*** | (2006.01) |

(52) U.S. Cl.

CPC ..... *E21B 33/1208* (2013.01); *E21B 17/1028* (2013.01); *E21B 23/10* (2013.01); *E21B 2200/01* (2020.05)

(58) Field of Classification Search

CPC ..... E21B 17/1021; E21B 17/1028; E21B 17/1042; E21B 23/0413; E21B 33/126

See application file for complete search history.

(56) References Cited

U.S. PATENT DOCUMENTS

| | | | |
|---|---|---|---|
| 2,117,538 | A | 5/1938 | Baker |
| 3,266,386 | A | 8/1966 | Domer |
| 3,358,768 | A | 12/1967 | Solum |

(Continued)

FOREIGN PATENT DOCUMENTS

| | | | |
|---|---|---|---|
| CN | 110998059 | A | 4/2020 |
| WO | 2006001707 | A1 | 1/2006 |

(Continued)

OTHER PUBLICATIONS

"VariPig" accessed Jan. 12, 2021 at [https://www.ftl.technology/products/varipig], 2021, 9 pages.

(Continued)

*Primary Examiner* — David Carroll

(74) *Attorney, Agent, or Firm* — Nila Ray; Jeffrey D. Frantz

(57) ABSTRACT

Embodiments described herein provide a multi-diameter thrust device that includes one or more thrust cups. Each thrust cup of the one or more thrust cups includes a first axial end hub disposed at a first axial end of the thrust cup; a second axial end hub disposed at a second axial end of the thrust cup; and a plurality of bowsprings. The thrust device is coupled to a wheel arrangement to limit an outer diameter of the one or more thrust cups.

19 Claims, 14 Drawing Sheets

(56) References Cited

U.S. PATENT DOCUMENTS

| | | | | |
|---|---|---|---|---|
| 3,487,753 | A | 1/1970 | Read | |
| 3,724,337 | A | 4/1973 | Richardson | |
| 4,638,726 | A | 1/1987 | Johnson et al. | |
| 4,787,458 | A * | 11/1988 | Langer | E21B 17/1028 175/325.1 |
| 6,381,797 | B1 * | 5/2002 | Filippovitch | F16L 55/46 15/104.061 |
| 7,025,142 | B2 | 4/2006 | Crawford | |
| 8,011,052 | B2 | 9/2011 | Kapustin et al. | |
| 2008/0141474 | A1 * | 6/2008 | Kapustin | B08B 9/0557 15/104.09 |
| 2011/0036560 | A1 * | 2/2011 | Vail, III | E21B 33/126 166/177.6 |
| 2014/0116724 | A1 | 5/2014 | McDougall et al. | |
| 2014/0158350 | A1 * | 6/2014 | Castillo | E21B 23/10 166/113 |
| 2015/0226019 | A1 * | 8/2015 | Umphries | E21B 17/1028 166/382 |
| 2015/0308207 | A1 * | 10/2015 | Mccormick | E21B 17/10 104/138.2 |
| 2016/0047209 | A1 * | 2/2016 | Castillo | E21B 23/14 166/386 |
| 2019/0169975 | A1 * | 6/2019 | Al-Qasim | G01N 21/952 |
| 2020/0123859 | A1 * | 4/2020 | Sivils | E21B 23/08 |
| 2021/0270102 | A1 * | 9/2021 | Massey | E21B 17/023 |
| 2022/0162917 | A1 | 5/2022 | Flander et al. | |

FOREIGN PATENT DOCUMENTS

| | | | |
|---|---|---|---|
| WO | 2008081402 | A1 | 7/2008 |
| WO | 2012125660 | A2 | 9/2012 |
| WO | 2016028565 | A1 | 2/2016 |
| WO | 2017200513 | A1 | 11/2017 |

OTHER PUBLICATIONS

International Search Report and Written Opinion of the PCT Application PCT/US2021/060527 dated Mar. 17, 2022, 11 pages.

International Preliminary Report on Patentability issued in the PCT Application No. PCT/US2021/060527 dated Jun. 1, 2023, 8 pages.

* cited by examiner

PRESSURE MODULATING MULTI-DIAMETER THRUST CUP ARRANGEMENT AND POSITIONING SYSTEM

CROSS-REFERENCE TO RELATED APPLICATION

This application is a Continuation-In-Part of U.S. Non-Provisional application Ser. No. 17/814,941 filed on Jul. 26, 2022, which is a Continuation of U.S. Non-Provisional application Ser. No. 17/101,965 filed on Nov. 23, 2020, which has granted as U.S. Pat. No. 11,434,701, and which are hereby incorporated by reference in its entirety for all purposes.

BACKGROUND

The present disclosure generally relates to systems and methods for multi-diameter thrust devices that include one or more multi-diameter thrust cups configured to provide thrust to push the multi-diameter thrust device, and an associated downhole tool, through a conduit, such as drill pipe.

This section is intended to introduce the reader to various aspects of conventional apparatus and methods that may be related to various aspects of the present techniques, which are described and/or claimed below. This discussion is believed to be helpful in providing the reader with background information to facilitate a better understanding of the various aspects of the present disclosure.

Downhole tool conveyance methods generally include tethering the downhole tool to a wireline or slickline cable, or to a rigid pipe, such as coiled tubing or segmented drill pipe. In the case of wireline or slickline conveyance in non-vertical wells, due the flexible nature of the wireline or slickline, it may become difficult to push the downhole tool along a horizontal or toe-up hole. If the downhole tool is conveyed through pipe that has an annular return path to the surface (such as a wireline logging tool conveyed through drill pipe), this limitation can be overcome by pumping fluid into the drill pipe to push the downhole tool along the non-vertical section of the well, taking advantage of fluid drag to propel the downhole tool forward. One limitation of this method; however, is that, in cases where the inner diameter (ID) of the drill pipe is significantly larger than the outer diameter (OD) of the downhole tool, the fluid drag may not be sufficient to propel the downhole tool forward because the viscous loss is too limited given the large annular cross section between the ID of drill pipe and the OD of the downhole tool.

In some embodiments, downhole tool conveyance can be more complicated as the capability of the conveyance tool may be exceeded. For example, in some embodiments, rapid travel of a downhole tool conveyance can lead to abrasion and potential failure of the conveyance. In still further embodiments, the conveyance may be overstressed or may be unable to overcome frictional forces due to pressure differentials generated during pump down conditions. It is therefore desired to alleviate these concerns.

SUMMARY

A summary of certain embodiments described herein is set forth below. It should be understood that these aspects are presented merely to provide the reader with a brief summary of these certain embodiments and that these aspects are not intended to limit the scope of this disclosure.

Certain embodiments of the present disclosure include a multi-diameter thrust device that includes one or more thrust cups. Each thrust cup of the one or more thrust cups includes a first axial end hub disposed at a first axial end of the thrust cup, wherein the first axial end of the thrust cup is configured to receive a flow of fluid; a second axial end hub disposed at a second axial end of the thrust cup, wherein the second axial end of the thrust cup is configured to at least partially block the fluid from flowing axially past the second axial end of the thrust cup; and a plurality of bowsprings. Each bowspring of the plurality of bowsprings includes a first axial end portion coupled to the first axial end hub and a second axial end portion coupled to the second axial end hub. The plurality of bowsprings are disposed circumferentially about a central axis of the multi-diameter thrust device.

Other embodiments of the present disclosure include a multi-diameter thrust device that includes a mandrel configured to be used as a housing or a flow line; and one or more thrust cups secured to the mandrel radially about the mandrel. Each thrust cup of the one or more thrust cups includes a first axial end hub disposed at a first axial end of the thrust cup, wherein the first axial end hub is configured to slide axially relative to the mandrel; a second axial end hub secured to the mandrel at a second axial end of the thrust cup; and a plurality of bowsprings configured to collapse radially. Each bowspring of the plurality of bowsprings includes a first axial end portion coupled to the first axial end hub and a second axial end portion coupled to the second axial end hub. The plurality of bowsprings are disposed circumferentially about a central axis of the multi-diameter thrust device. In addition, each bowspring of the plurality of bowsprings includes a first main bowspring portion extending axially from the first axial end portion of the bowspring. The first main bowspring portion includes a slot extending therethrough axially along the first main bowspring portion. Each bowspring of the plurality of bowsprings also includes a second main bowspring portion extending axially from the second axial end portion of the bowspring. The first and second main bowspring portions meet at an intermediate axial location along the multi-diameter thrust device. The second main bowspring portion does not include a slot extending therethrough. In addition, each thrust cup of the one or more thrust cups is configured to receive a flow of fluid at the first axial end of the thrust cup, and to at least partially block the fluid from flowing axially past the second axial of the thrust cup.

Other embodiments of the present disclosure include a multi-diameter thrust device that includes a mandrel configured to be used as a housing or a flow line; and one or more thrust cups secured to the mandrel radially about the mandrel. Each thrust cup of the one or more thrust cups includes a first axial end hub disposed at a first axial end of the thrust cup, wherein the first axial end hub is configured to slide axially relative to the mandrel; a second axial end hub secured to the mandrel at a second axial end of the thrust cup; and a plurality of bowsprings configured to collapse radially. Each bowspring of the plurality of bowsprings includes a first axial end portion coupled to the first axial end hub and a second axial end portion coupled to the second axial end hub. The plurality of bowsprings are disposed circumferentially about a central axis of the multi-diameter thrust device. Each bowspring of the plurality of bowsprings includes a first main bowspring portion extending axially from the first axial end portion of the bowspring. The first main bowspring portion is configured to be spaced circumferentially relative to first main bowspring portions of adjacent bowsprings of the plurality of bowsprings. Each bowspring of the plurality of bowsprings also includes a second main bowspring portion extending axially from the second axial end portion of the bowspring. The first and second main bowspring portions meet at an intermediate axial location along the multi-diameter thrust device. The second main bowspring portion is associated with a plurality of discrete asymmetrical curved fingers extending radially from the second main bowspring portion and at least partially disposed radially within the second main bowspring portion of a neighboring bowspring adjacent each other along the axial length of the second main bowspring portion. In addition, each thrust cup of the one or more thrust cups is configured to receive a flow of fluid at the first axial end of the thrust cup, and to at least partially block the fluid from flowing axially past the second axial of the thrust cup.

In one embodiment, a multi-diameter thrust device is disclosed. The multi-diameter thrust device comprises one or more thrust cups, each thrust cup of the one or more thrust cups, comprising a first axial end hub disposed at a first axial end of the thrust cup, wherein the first axial end of the thrust cup is configured to receive a flow of fluid. Each thrust cup may also comprise a second axial end hub disposed at a second axial end of the thrust cup, wherein the second axial end of the thrust cup is configured to at least partially block the fluid from flowing axially past the second axial end of the thrust cup. Each thrust cup may also comprise a plurality of bowsprings, each bowspring of the plurality of bowsprings having a first axial end portion coupled to the first axial end hub and a second axial end portion coupled to the second axial end hub, wherein the plurality of bowsprings are disposed circumferentially about a central axis of the multi-diameter thrust device. The device may also comprise a wheel arrangement connected to the one or more thrust cups, wherein the wheel arrangement is configured with a wheel with an exterior diameter that is configured to contact an interior diameter of a wellbore prior to a portion of the plurality of bowsprings.

In another example embodiment, a multi-diameter thrust device is disclosed. The device may comprise a mandrel configured to be used as a housing or a flow line and one or more thrust cups secured to the mandrel radially about the mandrel. Each thrust cup of the one or more thrust cups may comprise a first axial end hub disposed at a first axial end of the thrust cup, wherein the first axial end hub is configured to slide axially relative to the mandrel and a second axial end hub secured to the mandrel at a second axial end of the thrust cup. Each of the thrust cups may also comprise a plurality of bowsprings configured to collapse radially, each bowspring of the plurality of bowsprings having a first axial end portion coupled to the first axial end hub and a second axial end portion coupled to the second axial end hub, wherein the plurality of bowsprings are disposed circumferentially about a central axis of the multi-diameter thrust device. Each of the plurality of bowsprings may comprise a first main bowspring portion extending axially from the first axial end portion of the bowspring, wherein the first main bowspring portion comprises a slot extending therethrough axially along the first main bowspring portion and a second main bowspring portion extending axially from the second axial end portion of the bowspring, wherein the first and second main bowspring portions meet at an intermediate axial location along the multi-diameter thrust device, and wherein the second main bowspring portion does not comprise a slot extending therethrough. Each of the thrust devices may also comprise a relief valve arrangement configured to open at defined pressure within the thrust cup and allow pressure to be modulated. Each thrust cup of the one or more thrust cups may be configured to receive a flow of fluid at the first axial end of the thrust cup, and to at least partially block the fluid from flowing axially past the second axial end of the thrust cup.

Various refinements of the features noted above may be undertaken in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. The brief summary presented above is intended to familiarize the reader with certain aspects and contexts of embodiments of the present disclosure without limitation to the claimed subject matter.

BRIEF DESCRIPTION OF THE DRAWINGS

Various aspects of this disclosure may be better understood upon reading the following detailed description and upon reference to the drawings, in which.

DETAILED DESCRIPTION

One or more specific embodiments of the present disclosure will be described below. These described embodiments are only examples of the presently disclosed techniques. Additionally, to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

As used herein, the terms "connect," "connection," "connected," "in connection with," and "connecting" are used to mean "in direct connection with" or "in connection with via one or more elements"; and the term "set" is used to mean "one element" or "more than one element." Further, the terms "couple," "coupling," "coupled," "coupled together," and "coupled with" are used to mean "directly coupled together" or "coupled together via one or more elements." As used herein, the terms "up" and "down," "uphole" and "downhole," "upper" and "lower," "top" and "bottom," and other like terms indicating relative positions to a given point or element are utilized to more clearly describe some elements. Commonly, these terms relate to a reference point as the surface from which drilling operations are initiated as being the top (e.g., uphole or upper) point and the total depth along the drilling axis being the lowest (e.g., downhole or lower) point, whether the well (e.g., wellbore, borehole) is vertical, horizontal or slanted relative to the surface.

Figure 1A:
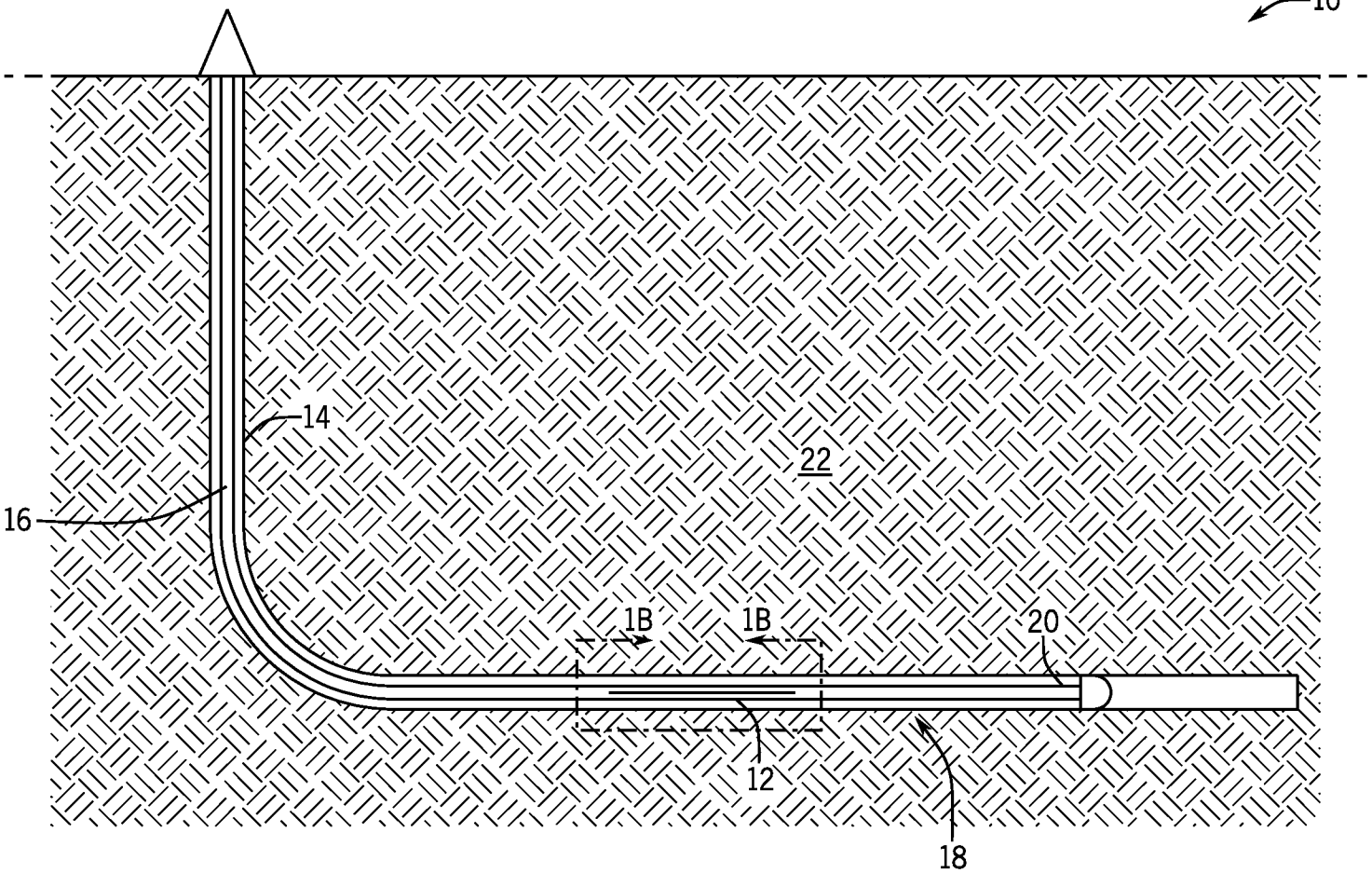
FIGS. 1A and 1B illustrate a well, within which a downhole tool (e.g., such as a logging tool) is conveyed down into a wellbore via pump down conveyance methods, in accordance with embodiments of the present disclosure.
Figure 1B:
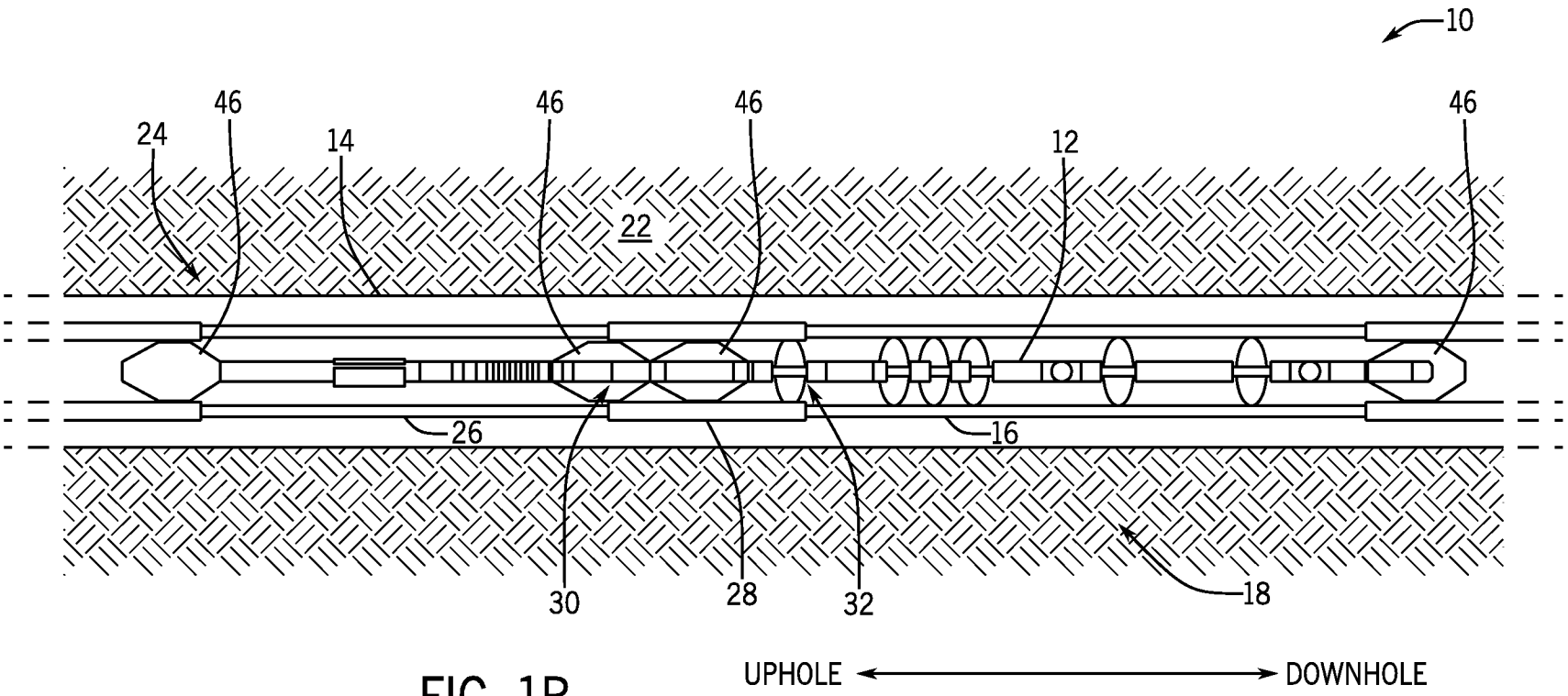

FIGS. 1A and 1B illustrate a well 10 within which a downhole tool 12 (e.g., such as a logging tool) is conveyed down into a wellbore 14 via pump down conveyance methods whereby, for example, a fluid flowing through drill pipe 16 is used to provide the motive force to drive the downhole tool 12 through the wellbore 14, as described in greater detail herein, particularly in non-vertical sections 18 of the wellbore 14. As illustrated in FIG. 1A, in certain embodiments, a reaming bottom hole assembly (BHA) 20 may be used to form the wellbore 14 through a subterranean formation 22.

As described above, conventional methods of conveying downhole tools 12 through non-vertical sections 18 of wells 10 by pumping fluid into drill pipe 16 to push the downhole tools 12 along the non-vertical sections 18 of the wells 10 may be limited where fluid drag is not sufficient to propel the downhole tools 12 forward in situations where the inner diameter (ID) of the drill pipe 16 is significantly larger than the outer diameter (OD) of the downhole tools 12. One possible solution to this situation is to increase the OD of some part of the downhole tool 12 to minimize the annular gap between the downhole tool 12 and the drill pipe 16. This solution; however, may not be possible in cases where the sections of drill pipe 16 do not have the same ID throughout the entire drill string 24. For example, as illustrated in FIG. 1B, in certain situations, individual sections 24, 26 of drill pipe 16 may have several different IDs 28 and crossovers in the same drill string 24, resulting in several restrictions 30 or expansions 32 in the ID of the drill pipe 16 until the downhole tool 12 reaches the end of the drill string 24. For example, in certain embodiments, the range of IDs for the drill pipe 16 through which the downhole tool 12 needs to pass may be on the order of 2⅜" to 4¹⁄₁₆". Moreover, in certain situations, knowing the exact ID for some drill strings 24 may be complex from an operational point of view.

It should be noted that the scenario illustrated in FIGS. 1A and 1B shows one example of the different types of situations where downhole tools 12 are conveyed into wells 10 and that may benefit from embodiments of the present disclosure. Other situations; however, are possible whereby other tools (e.g., other than downhole tools 12) are conveyed through other types of conduits (e.g., other than wellbores 14). Such embodiments may also benefit from the present disclosure. For example, similar problems may exist with pipeline pigging where a "pig" is pumped through a pipeline having multiple IDs. As defined herein, a "pig" may be an object that fills the circumference of a wellbore. Such "pigs" may be used, for example, to cause a localized obstruction to fluid flow.

Figure 2:
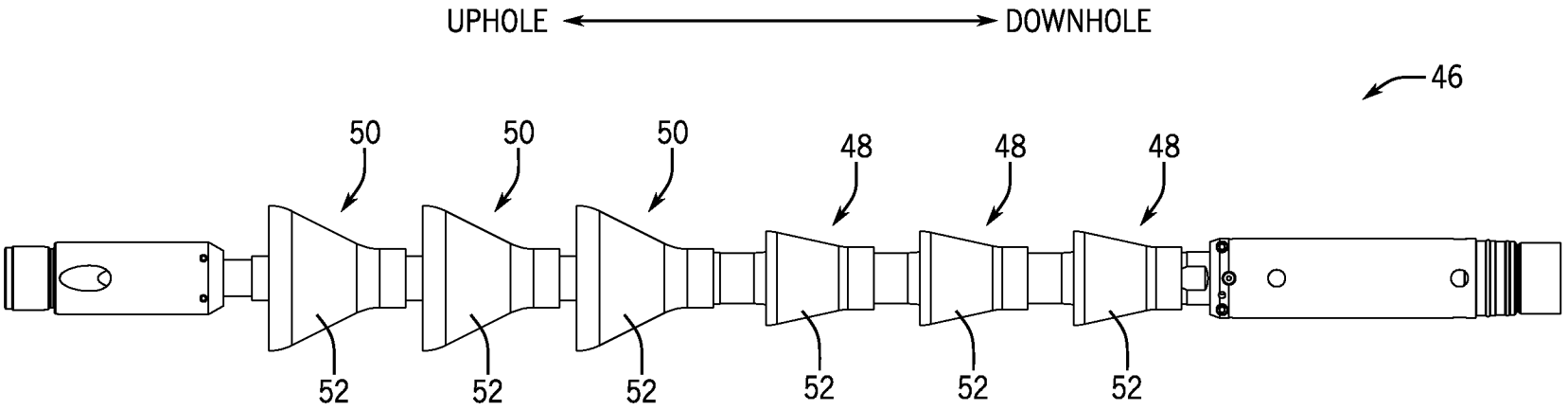
FIG. 2 illustrates an embodiment of a multi-diameter thrust device having a plurality of thrust elements spaced axially along the multi-diameter thrust device, in accordance with embodiments of the present disclosure.

As described in greater detail herein, one or more multi-diameter thrust devices 46 may be used to provide thrust to convey the downhole tool 12 through the wellbore 14, particularly in non-vertical sections of the wellbore 14. FIG. 2 illustrates an embodiment of the multi-diameter thrust device 46 having a plurality of thrust elements 48, 50 spaced axially along the multi-diameter thrust device 46. As illustrated, in certain embodiments, the plurality of thrust elements 48, 50 may include a first set of thrust elements 48 having a first OD and a second set of thrust elements 50 having a second, larger OD. In operation, the differing ODs of the thrust elements 48, 50 enables the multi-diameter thrust device 46 to provide thrust for the multi-diameter thrust device 46 through conduits (e.g., drill pipe 16) having differing IDs. In general, the larger diameter flexible thrust elements 50 are designed to collapse when they encounter an ID restriction in a conduit (e.g., drill pipe 16), allowing fluid to leak past them and engage smaller diameter thrust elements 48 instead.

In certain embodiments, cups 52 (e.g., flexible polyurethane "swab cups" or "butterfly disks") of various diameters may be used as the thrust elements 48, 50. In certain embodiments, the cups 52 of the thrust elements 48, 50 may be made from hydrogenated acrylonitrile butadiene rubber (HNBR). It has been found that polyurethane does not provide desirable results in relatively high temperature downhole environments. In addition, it has been found that balancing the need for flexibility with sufficient strength to avoid tearing the rubber of the thrust elements 48, 50 may prove challenging. Furthermore, designing the shape of the cups 52 of the thrust elements 48, 50 may present a problem if the downhole tool 12 needs to be fished (e.g., pulled out backwards up-hole) out of the drill pipe 16, in which case the cups 52 may tear, leaving behind debris in the wellbore 14 or even resulting in the downhole tool 12 getting stuck within the wellbore 14.

Figure 3:
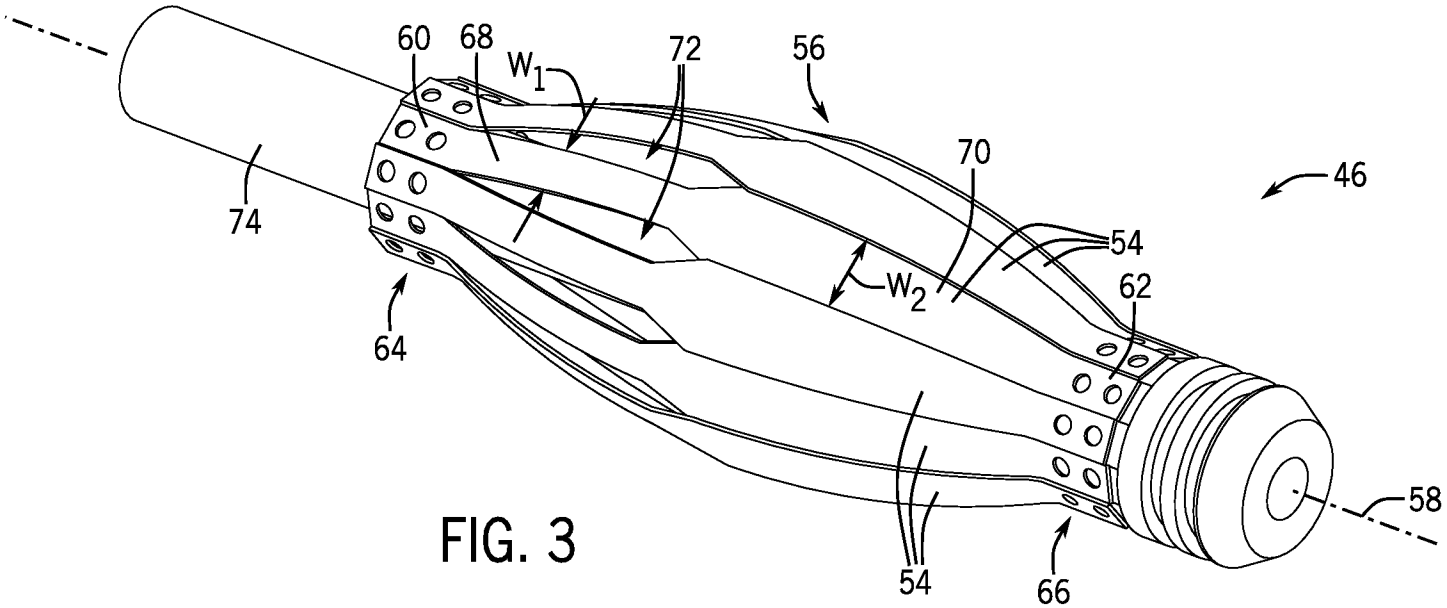
FIG. 3 is a perspective view of another embodiment of the multi-diameter thrust device in an expanded state, in accordance with embodiments of the present disclosure.

FIG. 3 is a perspective view of another embodiment of the multi-diameter thrust device 46. In the illustrated embodiment, the multi-diameter thrust device 46 includes a plurality of metal bowsprings 54 configured together to form a flexible metal thrust cup 56 when they are disposed (e.g., aligned) circumferentially about a central axis 58 of the multi-diameter thrust device 46. As used herein, the term "bowspring" is intended to mean a relatively thin (e.g., less than 10 millimeters, less than 5 millimeters, or even less), curved strip of a relatively flexible material (e.g., a metal, such as spring steel) that is substantially longer (e.g., over 10 times longer, or even more) than it is wide, and which is capable of being relatively straightened out (e.g., to reduce or even remove the curvature) for the purpose of facilitating the thrust cup 56 to adjust to the ID of a conduit (e.g., drill pipe 16) through which the multi-diameter thrust device 46 travels.

As described in greater detail herein, each bowspring 54 may include a first (e.g., upper or uphole) axial end portion 60 that is allowed to move (e.g., slide) axially with respect to the multi-diameter thrust device 46 and a second (e.g., lower or downhole) axial end portion 62 (e.g., at an opposite axial end of the bowspring 54) that is axially fixed in place with respect to the multi-diameter thrust device 46. As such, the bowsprings 54 may enable the multi-diameter thrust device 46 to receive a flow of fluid at an upper (e.g., uphole) axial end 64 of the multi-diameter thrust device 46, which may be blocked or at least partially blocked from flowing past a lower (e.g., downhole) axial end 66 of the multi-diameter thrust device 46 (e.g., when the fluid flows into an interior of the thrust cup 56) to generate thrust for the multi-diameter thrust device 46, as described in greater detail herein.

In addition, as illustrated in FIG. 3, in certain embodiments, the bowsprings 54 include a first (e.g., upper or uphole) main bowspring portion 68 extending from the first (e.g., upper or uphole) axial end portion 60 and a second (e.g., lower or downhole) main bowspring portion 70 extending from the second (e.g., lower or downhole) axial end portion 62 that meet at an intermediate axial location along the multi-diameter thrust device 46. As also illustrated in FIG. 3, in certain embodiments, the first main bowspring portions 68 of the bowsprings 54 are shaped such that they do not abut adjacent bowsprings 54 (e.g., are spaced circumferentially apart from adjacent bowsprings 54) when assembled together, whereas the second main bowspring portions 70 of the bowsprings 54 are shaped such that they do abut (e.g., make contact with) adjacent bowsprings 54 when assembled together. Specifically, as illustrated in FIG. 3, in certain embodiments, the first main bowspring portions 68 of the bowsprings 54 have a main width $W_1$ that is slightly smaller (e.g., less than 5% smaller, less than 10% smaller, less than 15% smaller, less than 20% smaller, less than 25% smaller, less than 30% smaller, less than 35% smaller, less than 40% smaller, and so forth) than a main width $W_2$ of the second main bowspring portions 70 of the bowsprings 54 such that circumferential openings 72 exist between adjacent first main bowspring portions 68 when assembled together, whereas adjacent second main bowspring portions 70 abut each other when assembled together. In addition, as also illustrated in FIG. 3, in certain embodiments, the first main bowspring portions 68 of the bowsprings 54 may include transition portions that transition from the main width $W_1$ of the first main bowspring portions 68 to the main width $w_2$ of the second main bowspring portions 70 of the bowsprings 54.

In addition, in the embodiment illustrated in FIG. 3, adjacent second main bowspring portions 70 of the bowsprings 54 have alternating mounting heights (e.g., relative to the central axis 58 of the multi-diameter thrust device 46) such that the second main bowspring portions 70 do not circumferentially interfere with each other. Rather, adjacent second main bowspring portions 70 of the bowsprings 54 overlap (or underlap) each other when compressed (e.g., collapsed) radially. For example, when the multi-diameter thrust device 46, illustrated in FIG. 3, travels into a portion of a conduit (e.g., drill pipe 16) having a smaller ID, the adjacent second main bowspring portions 70 of the bowsprings 54 move circumferentially relative to each other while still forming a relatively sealed OD while adjacent first main bowspring portions 68 of the bowsprings 54 still form circumferential openings 72 therebetween. Such an embodiment is relatively inexpensive and simple to manufacture and construct. At some point of radial compression; however, even adjacent first main bowspring portions 68 of the bowsprings 54 will begin to interfere with each other, as illustrated in FIG. 4.

Figure 4:
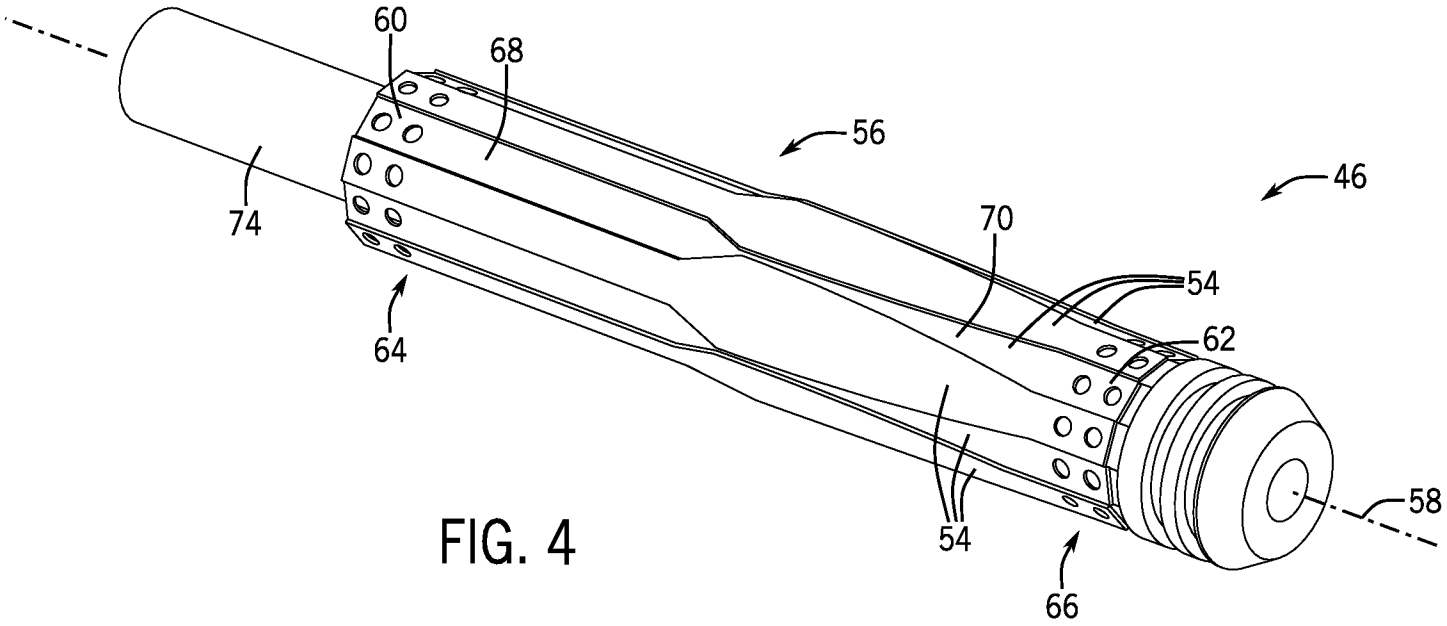
FIG. 4 is a perspective view of the multi-diameter thrust device of FIG. 3 in a collapsed state, in accordance with embodiments of the present disclosure.

The thrust cup 56 illustrated in FIGS. 3 and 4 are examples of one embodiment of a thrust cup configured to be secured to a mandrel 74 radially about the mandrel 74, wherein the thrust cup includes a plurality of metal bowsprings disposed circumferentially about a central axis 58 of the multi-diameter thrust device 46, and being configured to receive a flow of fluid at a first axial end of the thrust cup, to at least partially block the fluid from flowing axially past a second axial of the thrust cup, and to collapse radially to adjust to the ID of a conduit (e.g., drill pipe 16) through which the multi-diameter thrust device 46 travels. In certain embodiments, the mandrel 74 may be used as a housing (e.g., for cables, electronics, and so forth) or may be used as a flow line, for example, through which a fluid may flow.

Figure 5:
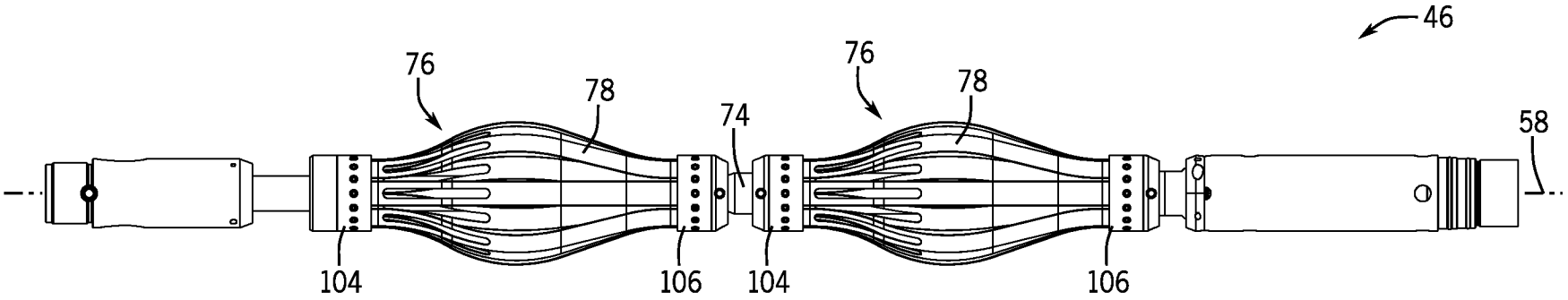
FIG. 5 is a side view of another embodiment of the multi-diameter thrust device, in accordance with embodiments of the present disclosure.
Figure 6:
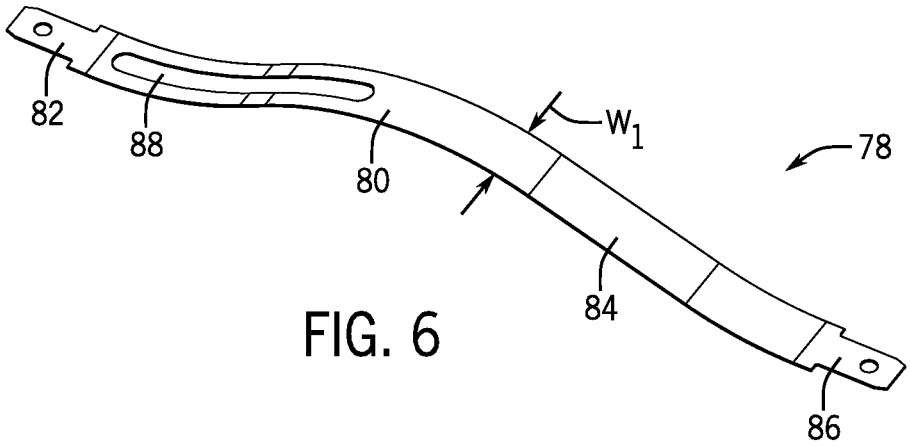
FIG. 6 is a perspective view of a bowspring of a thrust cup of the multi-diameter thrust device of FIG. 5, in accordance with embodiments of the present disclosure.

FIG. 5 is a side view of another embodiment of the multi-diameter thrust device 46 that includes a plurality of flexible metal thrust cups 76 disposed in series axially along the multi-diameter thrust device 46, each thrust cup 76 having a plurality of metal bowsprings 78. As illustrated in FIG. 6, similar to the bowsprings 54 described above, each bowspring 78 includes a first (e.g., upper or uphole) main bowspring portion 80 extending from a first (e.g., upper or uphole) axial end portion 82 of the bowspring 78 and a second (e.g., lower or downhole) main bowspring portion 84 extending from a second (e.g., lower or downhole) axial end portion 86 of the bowspring 78 that meet at an intermediate axial location along the multi-diameter thrust device 46. As also illustrated in FIG. 6, all of the portions 80, 82, 84, 86 of each bowspring 78 include a substantially constant width $W_1$ (e.g., within manufacturing tolerances, such as having less than 1% variance in width) along the entire axial length of the bowspring 78.

In addition, as also illustrated in FIG. 6, the first (e.g., upper or uphole) main bowspring portion 80 of each bowspring 78 includes a slot 88 extending therethrough axially along the first (e.g., upper or uphole) main bowspring portion 80, whereas the second (e.g., lower or downhole) main bowspring portion 84 does not include a slot extending therethrough, but rather is a continuous piece of metallic material. In general, the slot 88 allows a flow of fluid to be received therethrough, which may be blocked or at least partially blocked from flowing past a lower (e.g., downhole)

axial end of the multi-diameter thrust device 46 (e.g., when the fluid flows into an interior of the thrust cup 76) to generate thrust for the multi-diameter thrust device 46, as described in greater detail herein.

Returning to FIG. 5, in certain embodiments, a single thrust cup 76 may be sufficient to provide enough thrust to drive the multi-diameter thrust device 46 (and its associated downhole tool 12) downhole, but using multiple thrust cups 76 may add redundancy and reduce leakage past the thrust cups 76, for example, in situations where only relatively low pump rates are possible and/or when one of the thrust cups 76 is stopped in a connection where more leakage exists.

In addition, in the embodiment illustrated in FIG. 5, adjacent bowsprings 78 have alternating mounting heights (e.g., relative to the central axis 58 of the multi-diameter thrust device 46) such that the bowsprings 78 do not circumferentially interfere with each other. Rather, adjacent bowsprings 78 overlap (or underlap) each other when compressed (e.g., collapsed) radially. For example, when the multi-diameter thrust device 46 illustrated in FIG. 5 travels into a portion of a conduit (e.g., drill pipe 16) having a smaller ID, the adjacent bowsprings 78 move circumferentially relative to each other while still forming a relatively sealed OD to minimize leakage and to benefit from the deformation of the bowsprings 78 due to the impinging flow of fluid to actually contact each other and create a seal, decreasing even further the leakage.

Figure 8:
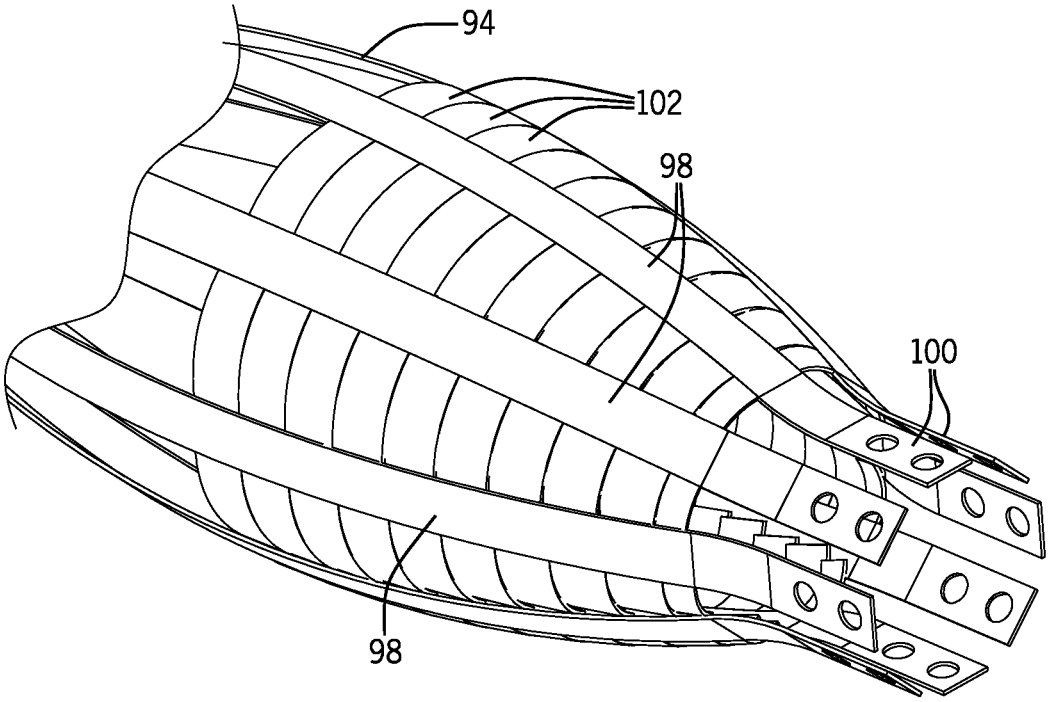
FIG. 8 is a perspective view of a portion of a thrust cup of the multi-diameter thrust device of FIG. 7, in accordance with embodiments of the present disclosure.
Figure 7:
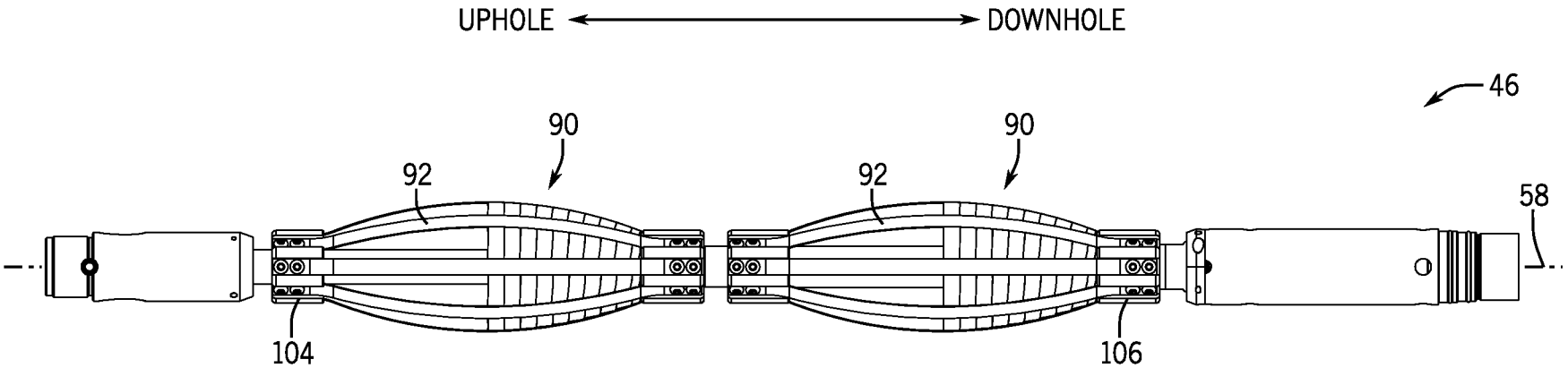
FIG. 7 is a side view of another embodiment of the multi-diameter thrust device, in accordance with embodiments of the present disclosure.
Figure 9:
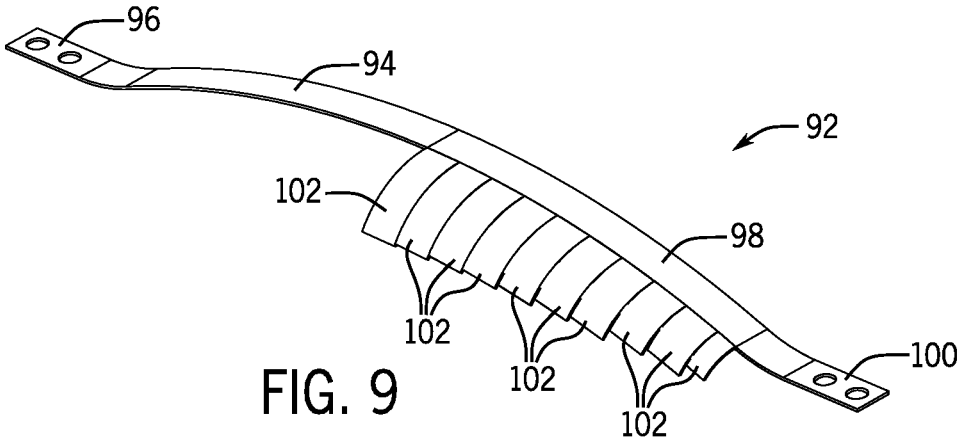
FIG. 9 is a perspective view of a bowspring and associated plurality of asymmetrical curved fingers of a thrust cup of the multi-diameter thrust device of FIG. 7, in accordance with embodiments of the present disclosure.
Figure 10:
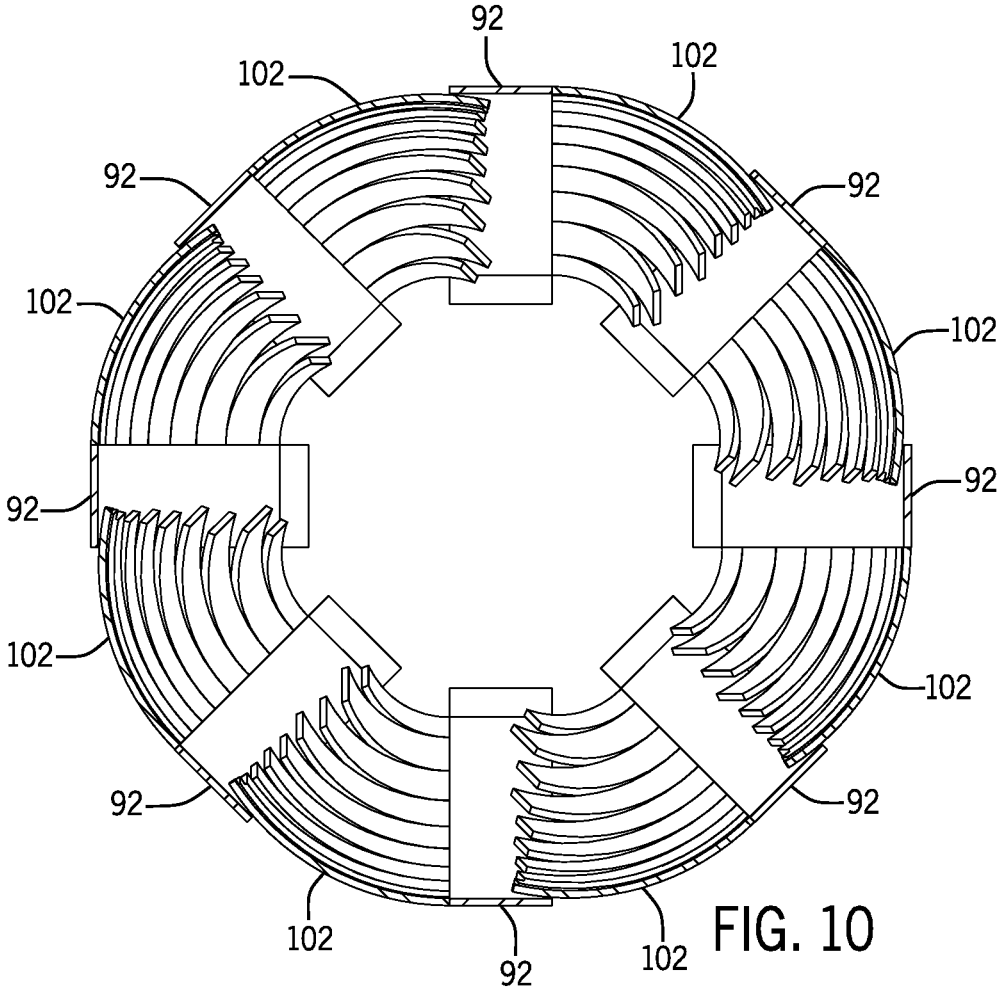
FIG. 10 is an end view of a plurality of bowsprings and their associated pluralities of asymmetrical curved fingers of a thrust cup of the multi-diameter thrust device of FIG. 7, in accordance with embodiments of the present disclosure.

FIG. 7 is a side view of another embodiment of the multi-diameter thrust device 46 that includes a plurality of flexible metal thrust cups 90 disposed in series axially along the multi-diameter thrust device 46, each thrust cup 90 having a plurality of metal bowsprings 92. As illustrated in FIGS. 8-10 similar to the bowsprings 54, 78 described above, each bowspring 92 includes a first (e.g., upper or uphole) main bowspring portion 94 extending from a first (e.g., upper or uphole) axial end portion 96 of the bowspring 92 and a second (e.g., lower or downhole) main bowspring portion 98 extending from a second (e.g., lower or downhole) axial end portion 100 of the bowspring 92 that meet at an intermediate axial location along the multi-diameter thrust device 46. As also illustrated in FIGS. 8-10, all of the portions 94, 96, 98, 100 of each bowspring 92 form a continuous piece of metallic material that include a substantially constant width $w_1$ (e.g., within manufacturing tolerances, such as having less than 1% variance in width) along the entire axial length of the bowspring 92.

As illustrated in FIGS. 8 to 10, the first (e.g., upper or uphole) main bowspring portions 94 of the bowsprings 92 are shaped such that they do not abut adjacent bowsprings 92 (e.g., are spaced circumferentially apart from adjacent bowsprings 92) when assembled together. In addition, while the second (e.g., lower or downhole) main bowspring portions 98 of the bowsprings 92 themselves are shaped such that they do not themselves abut adjacent bowsprings 92, each of the second (e.g., lower or downhole) main bowspring portions 98 of the bowsprings 92 is associated with a plurality of discrete (e.g., separate) asymmetrical curved fingers 102 that extend radially from second (e.g., lower or downhole) main bowspring portion 98 in the same radial direction (e.g., either clockwise or counterclockwise) relative to the central axis 58 of the multi-diameter thrust device 46 as all of the other asymmetrical curved fingers 102 of the thrust cup 90. Furthermore, the plurality of asymmetrical curved fingers 102 are adjacent each other along the axial length of the respective second (e.g., lower or downhole) main bowspring portion 98. In addition, as illustrated most clearly in FIG. 10, each of the asymmetrical curved fingers 102 are at least partially disposed radially within a respective second (e.g., lower or downhole) main bowspring portion 98 of a neighboring bowspring 92. In general, the circumferential space between first (e.g., upper or uphole) main bowspring portions 94 of the bowsprings 92 allow a flow of fluid to be received therethrough, which may be blocked or at least partially blocked from flowing past a lower (e.g., downhole) axial end of the multi-diameter thrust device 46 (e.g., when the fluid flows into an interior of the thrust cup 90) by the asymmetrical curved fingers 102 to generate thrust for the multi-diameter thrust device 46, as described in greater detail herein.

The asymmetrical curved fingers 102 are configured to increase the range of IDs that can be navigated without increasing leakage insofar as they curl down on only one lateral side of the respective bowspring 92, as illustrated by FIG. 9. As will be appreciated, each asymmetrical curved finger 102 is configured to move independently from the other asymmetrical curved fingers 102 of the respective bowspring 92, which allows the thrust cup 90 to be very flexible and maintain its shape without permanently deforming any of the bowsprings 92. In addition, the asymmetrical curved fingers 102 allow a far greater range of motion since each bowspring 92 holds the asymmetrical curved fingers 102 of its neighboring bowspring 92 (i.e., the other bowspring 92 that also contacts the asymmetrical curved fingers 102) in place. The curvature of the asymmetrical curved fingers 102 are forced by the neighboring bowspring 92 into a shape that closely matches the ID curvature of the conduit (e.g., drill pipe 16) through which the multi-diameter thrust device 46 travels. Because the asymmetrical curved fingers 102 slide radially within (i.e., rather than radially outside of) the neighboring bowspring 92, there is no risk of interference of neighboring bowsprings 92 of asymmetrical curved fingers 102, and there is also no risk of the edges of the asymmetrical curved fingers 102 getting caught on a relatively rough surface of the ID of the conduit (e.g., drill pipe 16) through which the multi-diameter thrust device 46 travels. In addition, due to the asymmetrical design of the curved fingers 102, portions of the thrust cup 90 will have a tendency to rotate slightly (e.g., such that the thrust cup 90 experiences slight torsion), which may provide a further benefit of reducing friction with the conduit (e.g., drill pipe 16) through which the multi-diameter thrust device 46 travels insofar as one end of the thrust cup 90 is allowed to rotate relative to the mandrel 74, as described in greater detail herein.

In general, the asymmetrical curved fingers 102 are long enough to be tucked under (e.g., radially within) the neighboring bowspring 92 when the multi-diameter thrust device 46 is assembled together in its relaxed state (e.g., before insertion into a conduit, which would cause compression of the bowsprings 92). As such, the fewer bowsprings 92 that are used, the longer the asymmetrical curved fingers 102 will need to be. In general, longer asymmetrical curved fingers 102 lead to more flexibility and lower internal stresses, while shorter asymmetrical curved fingers 102 lead to more stiffness and higher internal stresses. When considering how many individual asymmetrical curved fingers 102 to use on each bowspring 92, more (and narrower) asymmetrical curved fingers 102 lead to a more flexible design, but also lead to more leakage through gaps between the asymmetrical curved fingers 102. In certain embodiments, the asymmetrical curved fingers 102 may be narrower (e.g., have a smaller width $W_1$ near the second (e.g., lower or downhole) axial end portion 100 of the bowspring 92 than a width $W_2$ near the first (e.g., upper or uphole) axial end portion 96 of the bowspring 92 since the exposed length (i.e., before contacting the bottom of the neighboring bowspring 92) is less than the asymmetrical curved fingers 102 further back.

In certain embodiments, the asymmetrical curved fingers 102 may optionally be pre-bent before heat treatment to reduce the stresses experienced while flexing through the entire range of motion. In general, pre-bending adds complexity to the manufacturing process; however, changes in geometry (e.g., narrower asymmetrical curved fingers 102 or thinner base material) may be sufficient to keep material stresses in an acceptable range.

Returning to FIG. 7, similar to the thrust cup 76 described above, in certain embodiments, a single thrust cup 90 may be sufficient to provide enough thrust to drive the multi-diameter thrust device 46 (and its associated downhole tool 12) downhole, but using multiple thrust cups 90 may add redundancy and reduce leakage past the thrust cups 90, for example, in situations where only relatively low pump rates are possible and/or when one of the thrust cups 90 is stopped in a connection where more leakage exists.

Each of the thrust cups 56, 76, 90 described herein include bowsprings 54, 78, 92 that have sufficient bow height (e.g., maximum distance as measured from the central axis 58 of the multi-diameter thrust device 46) to match or slightly exceed the maximum ID of the conduit (e.g., drill pipe 16) through which the multi-diameter thrust device 46 travels. In addition, the bowsprings 54, 78, 92 have a width that is as narrow as possible to minimize leakage past the gap created by the top surface of the bowspring 54, 78, 92 and the curved surface of the surrounding conduit (e.g., drill pipe 16) through which the multi-diameter thrust device 46 travels.

Figure 11:
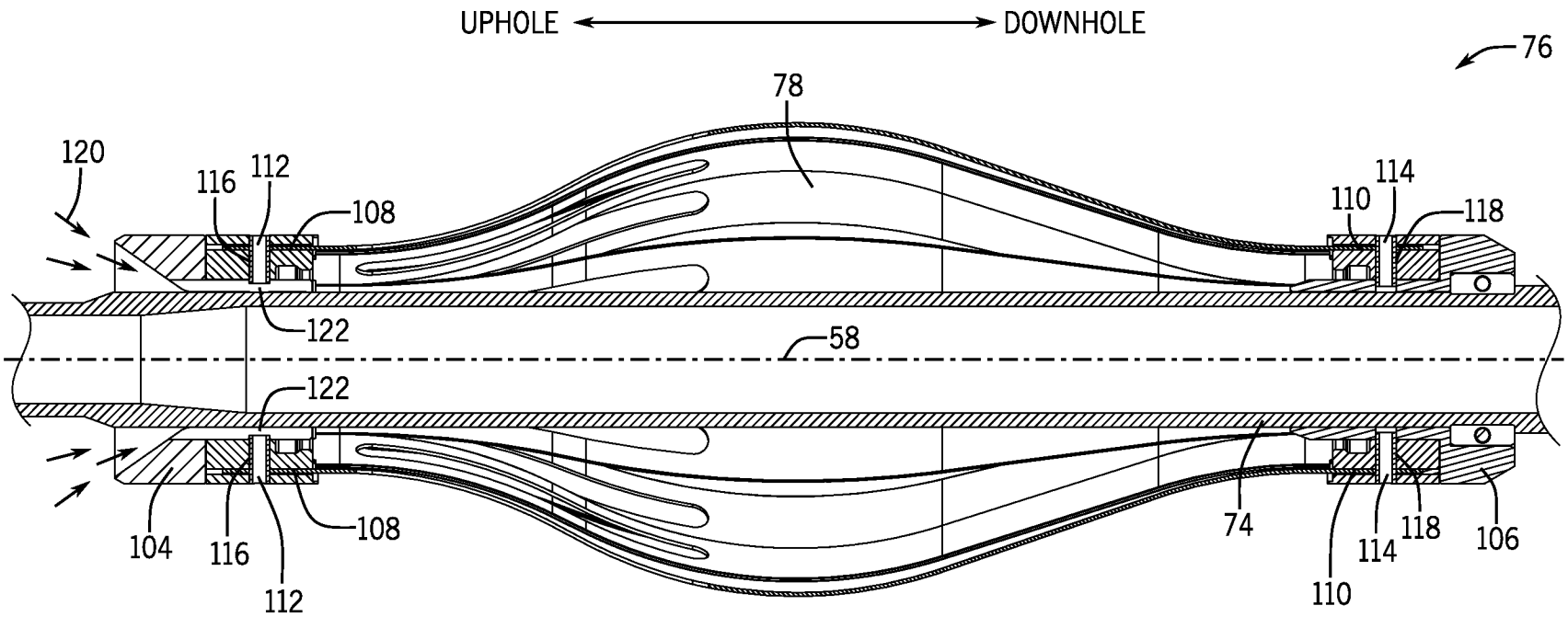
FIG. 11 is a cutaway side view of the thrust cup of FIG. 5, in accordance with embodiments of the present disclosure.

Regardless of the type of thrust cup 56, 76, 90, the bowsprings 54, 78, 92 may be mounted to the mandrel 74 using first and second axial end hubs 104, 106. For example, FIG. 11 is a cutaway side view of the thrust cup 76 of FIG. 5, illustrating how first (e.g., upper or uphole) axial end portions 82 of the bowsprings 78 may be coupled to a first (e.g., upper or uphole) axial end hub 104 and the second (e.g., lower or downhole) axial end portions 86 of the bowsprings 78 may be coupled to a second (e.g., lower or downhole) axial end hub 106. In particular, as illustrated, in certain embodiments, the axial end portions 82, 86 of the bowsprings 78 may be inserted into respective slots 108, 110 in the axial end hubs 104, 106 and secured in place by respective sets of fasteners 112, 114, which may be inserted through fastener holes 116, 118 through the axial end portions 82, 86. It will be appreciated that the bowsprings 54, 92 of the other thrust cups 56, 90 may be similarly coupled to the axial end hubs 104, 106.

As described in greater detail herein, in certain embodiments, the second (e.g., lower or downhole) axial end hub 106 may be secured to the mandrel 74 radially about the mandrel 74, whereas the first (e.g., upper or uphole) axial end hub 104 may be free to move (e.g., slide) axially relative to the mandrel 74 (e.g., by at least the amount needed to straighten out the bowsprings 78 when the multi-diameter thrust device 46 enters a minimum ID restriction of the conduit (e.g., drill pipe 16) through which the multi-diameter thrust device 46 travels. In addition, the first (e.g., upper or uphole) axial end hub 104 may also be free to rotate circumferentially about the mandrel 74, in certain embodiments (e.g., in the embodiment illustrated in FIGS. 7 to 10).

Returning to FIG. 11, in certain embodiments, the first (e.g., upper or uphole) axial end hub 104 may be capable of receiving at least a portion of a flow of fluid 120 through a gap 122 formed between the first (e.g., upper or uphole) axial end hub 104 and the mandrel 74, whereas the second (e.g., lower or downhole) axial end hub 106 forms a seal against the mandrel 74 (e.g., to maximize pressure drop and thrust generated by the thrust cup 76) insofar as it is fixedly secured to the mandrel 74.

Figure 12:
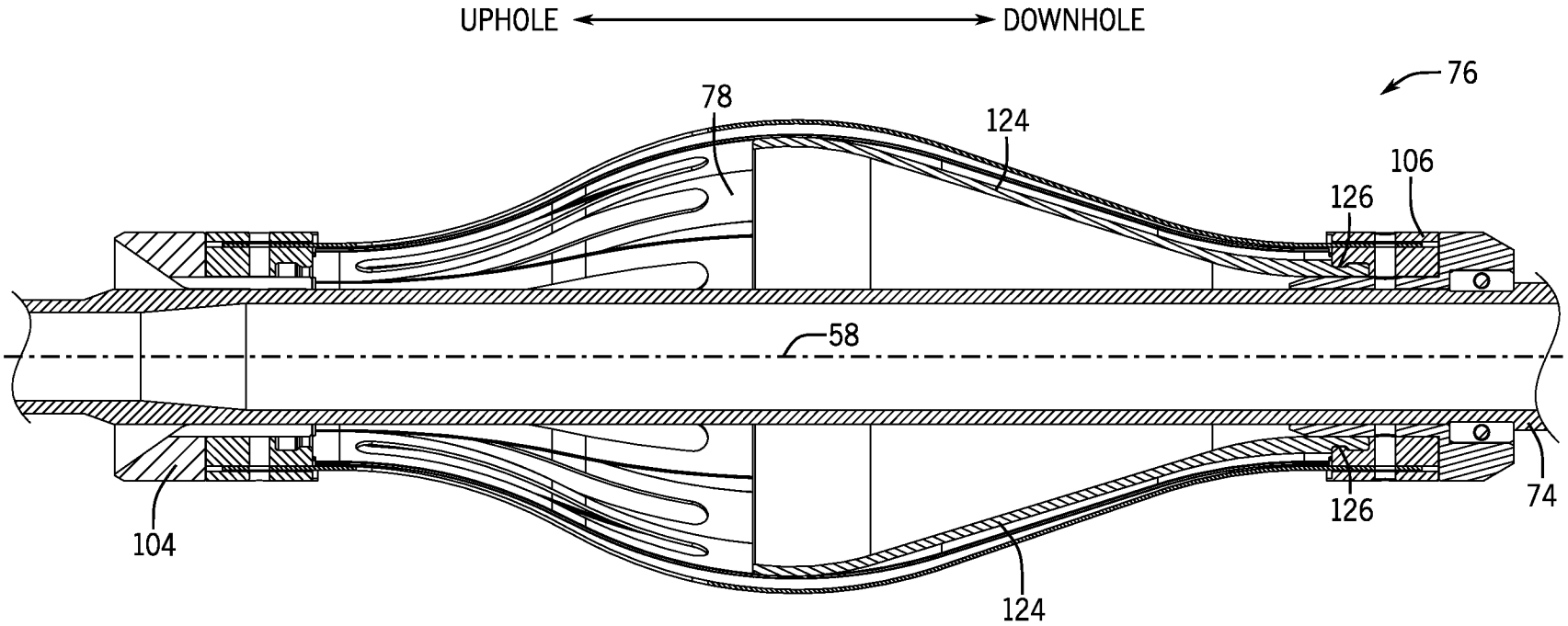
FIG. 12 is a cutaway side view of the thrust cup of FIG. 5, in accordance with embodiments of the present disclosure.
Figure 13:
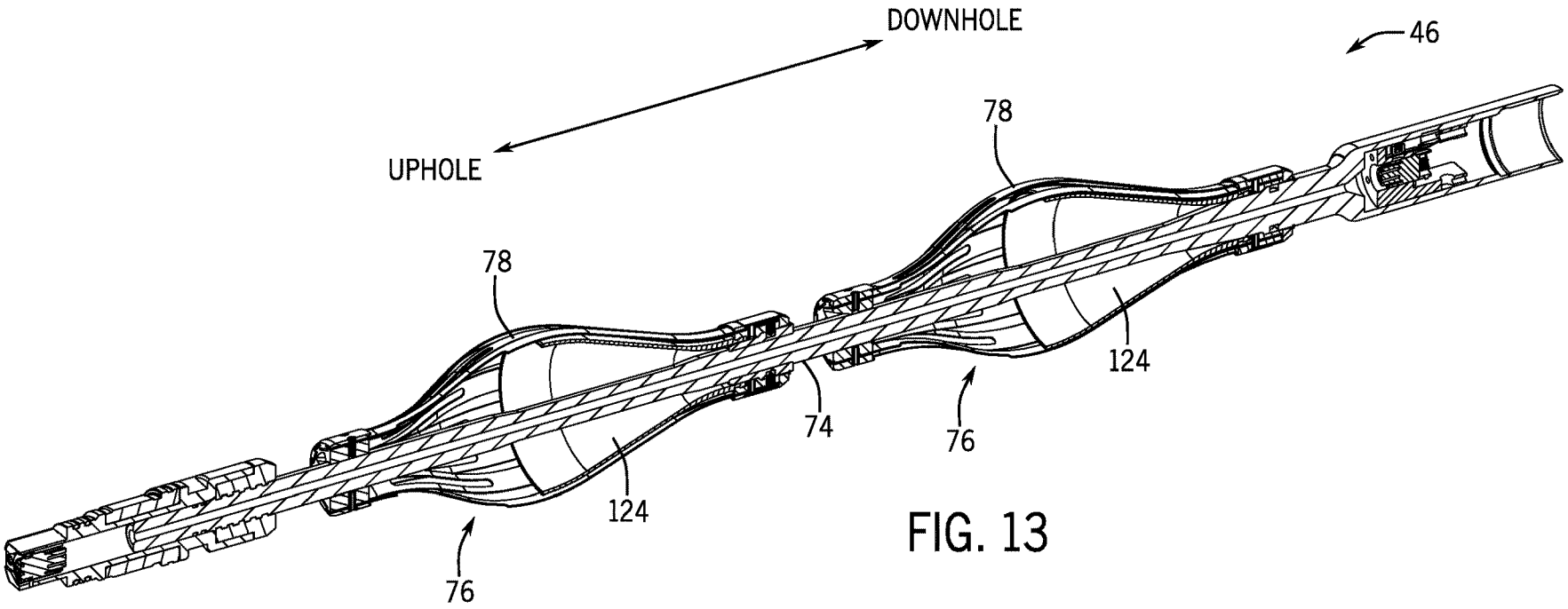
FIG. 13 is a perspective view of the thrust cup of FIG. 5, in accordance with embodiments of the present disclosure.

In addition, in certain embodiments, the thrust cups 56, 76, 90 may include an elastomeric bladder 124 even further reduce leakage through the thrust cup 56, 76, 90. FIGS. 12 and 13 are cutaway side and perspective views, respectively, of the thrust cup 76 of FIG. 5, illustrating how the bladder 124 may be disposed radially within the bowsprings 78 (e.g., radially within the second (e.g., lower or downhole) main bowspring portions 84 of the bowsprings 78. In addition, as illustrated most clearly in FIG. 12, in certain embodiments, the bladder 124 may be configured to be secured to the second (e.g., lower or downhole) axial end hub 106. For example, in certain embodiments, the bladder 124 may be held in place between the bowsprings 78 and the second (e.g., lower or downhole) axial end hub 106 by a lip 126 that extends from the second (e.g., lower or downhole) axial end hub 106 toward the bowsprings 78.

In certain embodiments, any combination and/or number of thrust cups 56, 76, 90 may be used as part of the multi-diameter thrust device 46. In addition, in certain embodiments, any combination and/or number of thrust cups 56, 76, 90 in addition to any combination and/or number of the thrust elements 48, 50 illustrated in FIG. 2 (e.g., in smaller ID restrictions) may be used as part of the multi-diameter thrust device 46.

Figure 14:
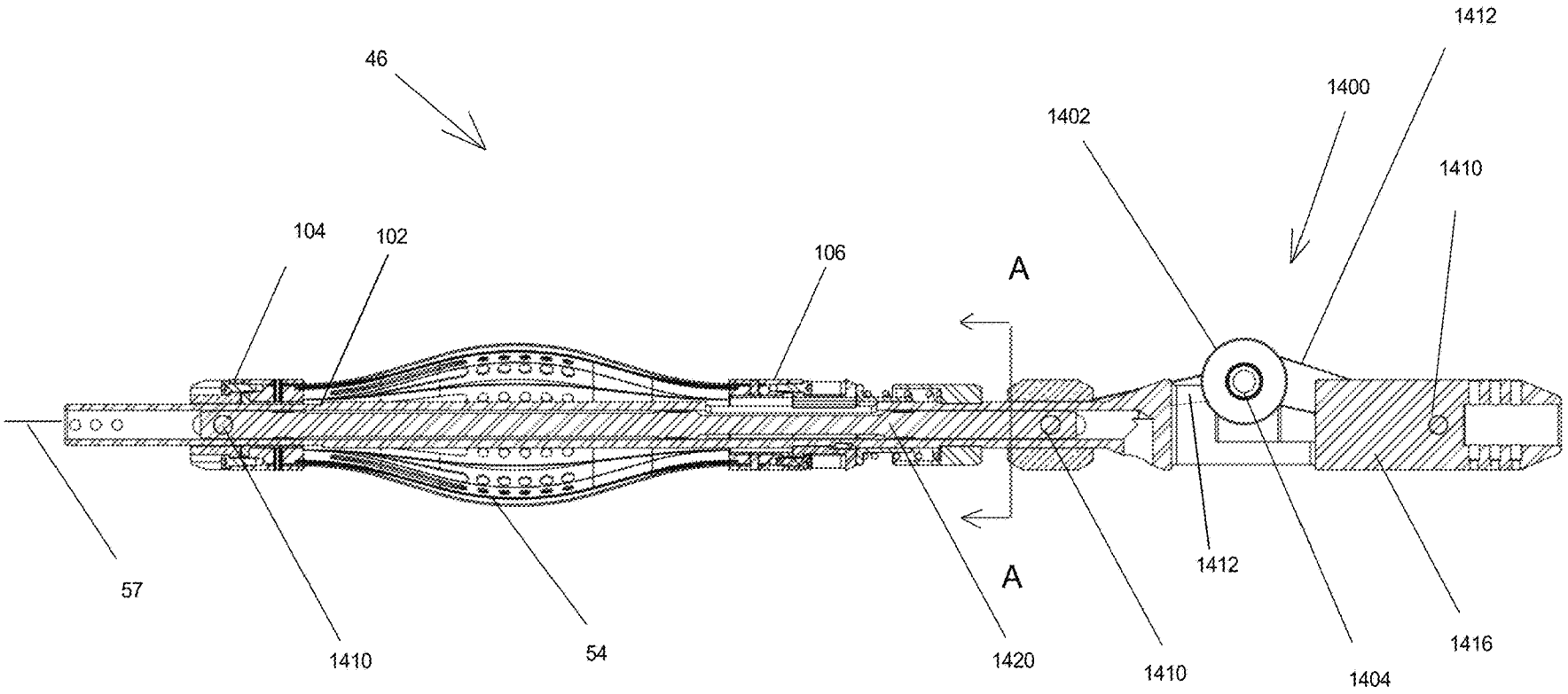
FIG. 14 is an expanded view of an embodiment of the disclosure with a wheel arrangement.

Referring to FIG. 14, an expanded view of an embodiment of the disclosure is presented. In this view, the embodiments described above in FIGS. 1 to 13 may be incorporated. FIG. 14 provides a wheel arrangement 1400 that limits the amount of friction created between the bowsprings 54 and the interior of the wellbore (not shown) during pump down conveyance methods. In the embodiments disclosed in FIGS. 1 to 13, portions of the embodiments, such as the bowsprings 54, may contact the inside of the wellbore, suffering abrasion on the contacting surfaces and creating frictional forces against the interior of the wellbore. In some embodiments, these frictional forces may exceed the forces created by the pressure differential across the thrust cups during a pump down conveyance method. To alleviate these concerns, the wheel arrangement 1400 is used to stabilize the overall device 46 within the wellbore and relieve some of the frictional forces created by the bowsprings against the interior of the wellbore by limiting the outer diameter of the bowsprings. The wheel arrangement 1400 may be connected to the remainder of the device 46 through two mechanical connections 1410, such as a pin. In embodiments, as illustrated, the wheel arrangement 1400 may be connected (at the left side in FIG. 14) to an internal rod 1420, known as a "push rod" and may be connected (at the right side in FIG. 14) to an end hub 1416 of the wheel arrangement 1400. In one or more embodiments, the wheel 1402 may be pivotably coupled to the mechanical connections 1410 by way of support members 1412.

The outermost diameter of the wheel 1402 of the wheel arrangement 1400 may extend radially further from the axis 57 of the device 46 than an outer diameter of the bowsprings 54 and may be configured to contact the interior of the wellbore. The outermost diameter of the wheel 1402 may be configured to change based on the inner diameter of the wellbore. In one or more embodiments, if the inner diameter of the wellbore is less than the outermost diameter of the wheel 1402 in its original disposition, the outermost diameter of the wheel 1402 may be configured to compress such that it fits within the inner diameter of the wellbore. Compression of the outermost diameter of the wheel 1402 causes the internal rod 1420 to shift by way of forces from the support member 1412 through the mechanical connection 1410. The wheel 1402 of the wheel arrangement 1400 may be configured with a sealed bearing 1404 to allow free rotation of the wheel 1402 during movement. A bearing 1404 may allow for the free rotation of the wheel 1402. The bearing 1404 may be any type of sealed bearing to provide for foreign material exclusion from the inside of the bearing 1404. The bearing 1404 may also be configured without lubricating liquids that may degrade in aggressive temperatures found in the downhole environment. The type of bearing 1404 that may be used include, but are not limited to ball bearings and wheel bearings.

In one or more embodiments, device 46 may include one or more bowsprings 54 (as discussed above with reference to FIGS. 1 to 13) coupled between an upper hub 104 and a lower hub 106 along a mandrel 102. The lower hub 106 may be affixed such that it does not translate along mandrel 102. The upper hub 104 of the device 46 may be coupled to the internal rod 1420 by way of a mechanical connection 1410 and may translate along the mandrel 102. In one embodiment, shifting of the upper hub 104 in a first direction may cause collapse of the bowsprings 54, and shifting of the upper hub 104 in a second direction may cause expanding of the bowsprings 54. Thus, when the outermost diameter of the wheel 1402 is made smaller by entering a smaller inner diameter wellbore, the internal rod 1420 may shift to the left, thus shifting the upper hub 104 to the left and collapsing the bowsprings 54. Alternatively, when the outermost diameter of the wheel 1402 is made larger by entering a larger inner diameter wellbore, the internal rod 1420 may shift to the right, thus shifting the upper hub 104 to the right and expanding the bowsprings 54.

While a single wheel 1402 is depicted in FIG. 14, in one or more embodiments, the wheel arrangement 1400 may include a second wheel, where the second wheel is connected to the mechanical connections 1410 by way of further support members. Further, while a single set of bowstrings 54 and a single wheel arrangement 1400 are depicted, in one or more embodiments, the device 46 may include a second set of bowstrings 54 having a second wheel arrangement 1400.

Figure 15:
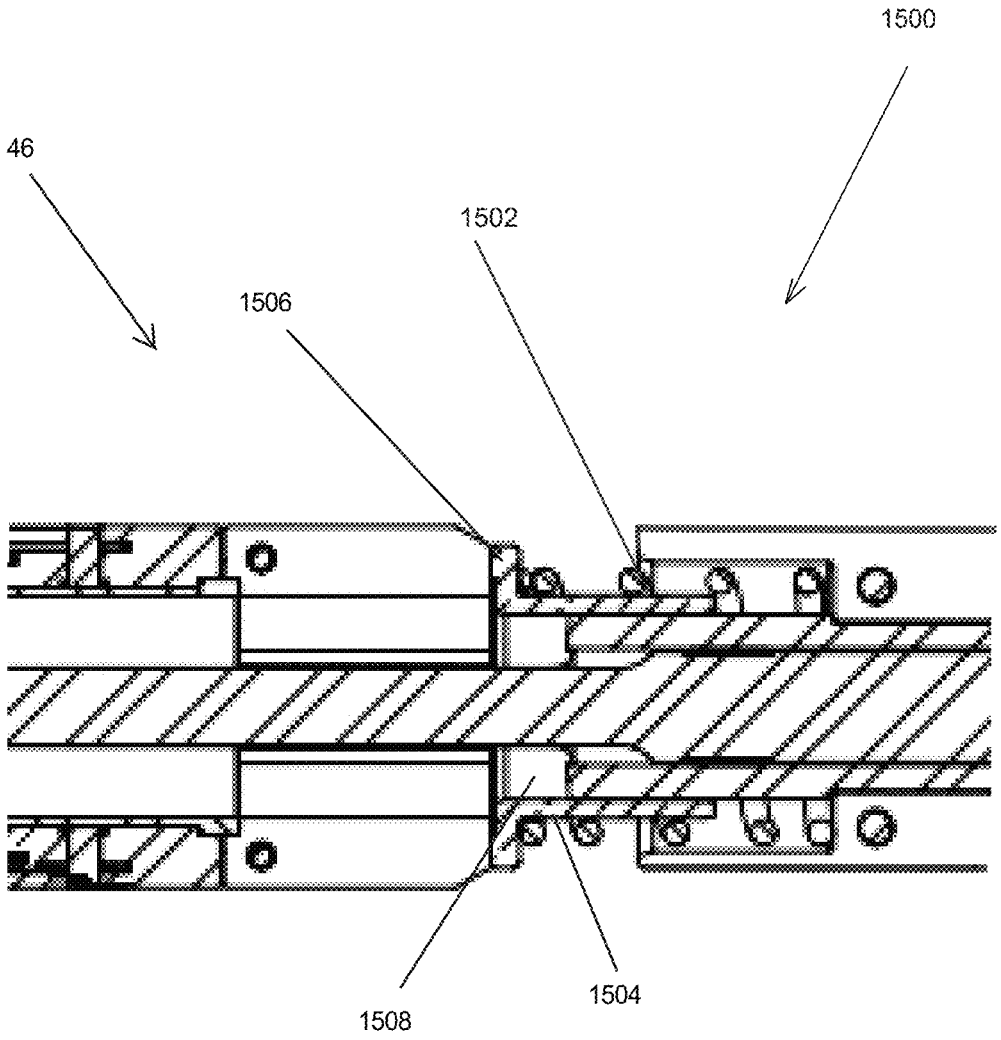
FIG. 15 is an expanded view of an embodiment with a pressure relief mechanism.

Referring to FIG. 15, an expanded view of a relief valve arrangement 1500. The relief valve arrangement 1500 is configured to limit the amount of pressure that the overall device is exposed to in field conditions. For example, when the device 46 is placed within a wellbore, and a pump is actuated, the device 46 will be transported downhole at a rapid speed. If the operator accidentally turns on the pump to a higher-pressure value than is needed, the greater amount of force on the bowsprings 54 may bend the bowsprings 54, consequently lodging the device 46 within the wellbore. Such lodging may be difficult to remove. To prevent such overpressurization, the relief valve arrangement 1500 allows excessive pressure to pass through the device, thereby limiting damage to the bowsprings 54. In embodiments, a spring 1502 with a known spring factor k, is installed within the device 46 such that progressive amount of opening occurs within the device 46 at a specific pressure. The spring 1502 interacts with a collar 1504. The collar 1504 is provided with a lip 1506. When pressure enters the chamber 1508 and exerts a greater force in the chamber than the holding force of the spring 1502, the collar 1504 will move, opening to the exterior of the device 46, thus relieving pressure. The spring 1502 may be biased such that upon a diminished pressure, the relief valve arrangement 1500 closes. In embodiments, the spring 1502 may be placed within a shroud to prevent materials from lodging within the spring 1502 and preventing actuation at known forces. As will be understood, the spring 1502 may be made such that it can be quickly exchanged for another spring of a different k factor, thereby modifying the overall force needed to open the relief valve arrangement 1500. In one example embodiment, the collar 1504 may translate along an axis (57 as shown in FIG. 14) of the device 46. Other types of relief valve arrangement 1500 may be used with the device 46, therefore the description provided should not be considered limiting.

Embodiments of the disclosure will now be discussed. The embodiments recited should not be considered limiting. In one embodiment, a multi-diameter thrust device is disclosed. The multi-diameter thrust device comprises one or more thrust cups, each thrust cup of the one or more thrust cups, comprising a first axial end hub disposed at a first axial end of the thrust cup, wherein the first axial end of the thrust cup is configured to receive a flow of fluid. Each thrust cup may also comprise a second axial end hub disposed at a second axial end of the thrust cup, wherein the second axial end of the thrust cup is configured to at least partially block the fluid from flowing axially past the second axial end of the thrust cup. Each thrust cup may also comprise a plurality of bowsprings, each bowspring of the plurality of bowsprings having a first axial end portion coupled to the first axial end hub and a second axial end portion coupled to the second axial end hub, wherein the plurality of bowsprings are disposed circumferentially about a central axis of the multi-diameter thrust device. The device may also comprise a wheel arrangement connected to the one or more thrust cups, wherein the wheel arrangement is configured with a wheel with an exterior diameter that is configured to contact an interior diameter of a wellbore prior to a portion of the plurality of bowsprings.

In another example embodiment, the multi-diameter thrust device further includes a mandrel and an internal rod, wherein the internal rod is disposed within the mandrel and is coupled to the first axial end hub by way of a first mechanical connection, and wherein the internal rod and the first axial end hub are configured to translate along the mandrel. Further, the wheel arrangement is coupled to the internal rod such that when the interior diameter of the wellbore changes, the exterior diameter of the wheel is configured to change in accordance with the change in the interior diameter of the wellbore and translate the internal rod along the mandrel.

In another example embodiment, when the interior diameter of the wellbore gets smaller, the exterior diameter of the wheel gets smaller and the internal rod and the first axial end hub shift in a first direction, wherein the first direction is away from the second axial end hub. Further, when the interior diameter of the wellbore gets larger, the exterior diameter of the wheel gets larger and the internal rod and the first axial end hub shift in a second direction, wherein the second direction is towards the second axial end hub.

In another example embodiment, the wheel arrangement further includes an end hub, a first support member, wherein the first support member is coupled to the wheel and the internal rod by way of a second mechanical connection such that when the exterior diameter of the wheel changes, the internal rod translates along the mandrel, and a second support member, wherein the second support member is coupled to the wheel and the end hub of the wheel arrangement by way of a third mechanical connection.

In another example embodiment, the first axial end hub is disposed radially about the mandrel.

In another example embodiment, the second axial end hub is secured to the mandrel radially about the mandrel.

In another example embodiment, the multi-diameter thrust device provides that the wheel arrangement is further configured with a bearing about which the wheel is configured to rotate.

In another example embodiment, the multi-diameter thrust device provides that the wheel arrangement comprises at least two wheels.

In another example embodiment, the multi-diameter thrust device provides that the wheel arrangement is configured from stainless steel.

In another example embodiment, the multi-diameter thrust device may further comprise a plurality of thrust cups disposed in series axially along the multi-diameter thrust device.

In another example embodiment, the multi-diameter thrust device is configured wherein the plurality of bowsprings of each thrust cup of the one or more thrust cups are configured to collapse radially.

In another example embodiment, the multi-diameter thrust device may be configured wherein each bowspring of the plurality of bowsprings of each thrust cup of the one or more thrust cups comprises: a first main bowspring portion extending axially from the first axial end portion of the bowspring, wherein the first main bowspring portion is configured to be spaced circumferentially apart from first main bowspring portions of adjacent bowsprings of the plurality of bowsprings. The device may also comprise a second main bowspring portion extending axially from the second axial end portion of the bowspring, wherein the first and second main bowspring portions meet at an intermediate axial location along the multi-diameter thrust device, and wherein the second main bowspring portion is configured to contact main bowspring portions of adjacent bowsprings of the plurality of bowsprings.

In another example embodiment, the device may be configured wherein each bowspring of the plurality of bowsprings of each thrust cup of the one or more thrust cups comprises a first main bowspring portion extending axially from the first axial end portion of the bowspring, wherein the first main bowspring portion comprises a slot extending therethrough axially along the first main bowspring portion. The bowspring may also be configured with a second main bowspring portion extending axially from the second axial end portion of the bowspring, wherein the first and second main bowspring portions meet at an intermediate axial location along the multi-diameter thrust device, and wherein the second main bowspring portion does not comprise a slot extending therethrough.

In another example embodiment, the device may further comprise a wheel arrangement connected to the one or more thrust cups, wherein the wheel arrangement is configured with a wheel with an exterior diameter that is configured to contact an interior diameter of a wellbore prior to a portion of the plurality of bowsprings.

In another example embodiment, the device may be configured wherein the relief valve arrangement is configured with a movable collar and spring.

In another example embodiment, the device may be configured wherein the relief valve arrangement is configured wherein the movable collar translates along an axis of the device.

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

The invention claimed is:

1. A multi-diameter thrust device, comprising:

one or more thrust cups, each thrust cup of the one or more thrust cups comprising:

a first axial end hub disposed at a first axial end of the thrust cup, wherein the first axial end of the thrust cup is configured to receive a flow of fluid;

a second axial end hub disposed at a second axial end of the thrust cup, wherein the second axial end of the thrust cup is configured to at least partially block the fluid from flowing axially past the second axial end of the thrust cup;

a plurality of bowsprings, each bowspring of the plurality of bowsprings having a first axial end portion coupled to the first axial end hub and a second axial end portion coupled to the second axial end hub, wherein the plurality of bowsprings are disposed circumferentially about a central axis of the multi-diameter thrust device;

a wheel arrangement connected to the one or more thrust cups via one or more support members, wherein the wheel arrangement is configured with a wheel with an exterior diameter that is configured to contact an interior diameter of a wellbore prior to a portion of the plurality of bowsprings;

a mandrel;

an internal rod, wherein the internal rod is disposed within the mandrel and is coupled to the first axial end hub by way of a first mechanical connection, and wherein the internal rod and the first axial end hub are configured to translate along the mandrel; and the wheel arrangement is coupled to the internal rod such that when the interior diameter of the wellbore changes, the exterior diameter of the wheel is configured to change in accordance with the change in the interior diameter of the wellbore and translate the internal rod along the mandrel.

2. The multi-diameter thrust device according to claim 1, wherein:

when the interior diameter of the wellbore gets smaller, the exterior diameter of the wheel gets smaller and the internal rod and the first axial end hub shift in a first direction, wherein the first direction is away from the second axial end hub; and when the interior diameter of the wellbore gets larger, the exterior diameter of the wheel gets larger and the internal rod and the first axial end hub shift in a second direction, wherein the second direction is towards the second axial end hub.

3. The multi-diameter thrust device according to claim 1, wherein the wheel arrangement further comprises:

an end hub;

a first support member, wherein the first support member is coupled to the wheel and the internal rod by way of a second mechanical connection such that when the exterior diameter of the wheel changes, the internal rod translates along the mandrel; and a second support member, wherein the second support member is coupled to the wheel and the end hub of the wheel arrangement by way of a third mechanical connection.

4. The multi-diameter thrust device of claim 1, wherein the first axial end hub is disposed radially about the mandrel.

5. The multi-diameter thrust device of claim 1, wherein the second axial end hub is secured to the mandrel radially about the mandrel.

6. The multi-diameter thrust device according to claim 1, wherein the wheel arrangement is further configured with a bearing about which the wheel is configured to rotate.

7. The multi-diameter thrust device according to claim 1, wherein the wheel arrangement comprises at least two wheels.

8. The multi-diameter thrust device according to claim 1, wherein the wheel arrangement is configured from stainless steel.

9. The multi-diameter thrust device according to claim 1, further comprising:

a relief valve arrangement configured to open at defined pressure within the thrust cup and allow pressure to be modulated, and wherein the relief valve arrangement is configured with a movable collar and a spring.

10. The multi-diameter thrust device of claim 1, comprising a plurality of thrust cups disposed in series axially along the multi-diameter thrust device.

11. The multi-diameter thrust device of claim 1, wherein the plurality of bowsprings of each thrust cup of the one or more thrust cups are configured to collapse radially.

12. The multi-diameter thrust device of claim 1, wherein each bowspring of the plurality of bowsprings of each thrust cup of the one or more thrust cups comprises:

a first main bowspring portion extending axially from the first axial end portion of the bowspring, wherein the first main bowspring portion is configured to be spaced circumferentially apart from the first main bowspring portions of adjacent bowsprings of the plurality of bowsprings; and a second main bowspring portion extending axially from the second axial end portion of the bowspring, wherein the first and second main bowspring portions meet at an intermediate axial location along the multi-diameter thrust device, and wherein the second main bowspring portion is configured to contact the second main bowspring portions of adjacent bowsprings of the plurality of bowsprings.

13. The multi-diameter thrust device of claim 1, wherein each bowspring of the plurality of bowsprings of each thrust cup of the one or more thrust cups comprises:

a first main bowspring portion extending axially from the first axial end portion of the bowspring, wherein the first main bowspring portion comprises a slot extending therethrough axially along the first main bowspring portion; and a second main bowspring portion extending axially from the second axial end portion of the bowspring, wherein the first and second main bowspring portions meet at an intermediate axial location along the multi-diameter thrust device, and wherein the second main bowspring portion does not comprise a slot extending therethrough.

14. A multi-diameter thrust device, comprising:

a mandrel; and one or more thrust cups secured to the mandrel radially about the mandrel, each thrust cup of the one or more thrust cups comprising:

a first axial end hub disposed at a first axial end of the thrust cup, wherein the first axial end hub is configured to slide in an axial direction relative to the mandrel;

a second axial end hub secured to the mandrel at a second axial end of the thrust cup;

a plurality of bowsprings configured to collapse radially, each bowspring of the plurality of bowsprings having a first axial end portion coupled to the first axial end hub and a second axial end portion coupled to the second axial end hub, wherein the plurality of bowsprings are disposed circumferentially about a central axis of the multi-diameter thrust device; and wherein each bowspring of the plurality of bowsprings comprises:

a first main bowspring portion extending axially from the first axial end portion of the bowspring, wherein the first main bowspring portion comprises a slot extending therethrough axially along the first main bowspring portion; and a second main bowspring portion extending axially from the second axial end portion of the bowspring, wherein the first and second main bowspring portions meet at an intermediate axial location along the multi-diameter thrust device, and wherein the second main bowspring portion does not comprise a slot extending therethrough; and a relief valve arrangement configured to open at defined pressure within the thrust cup and allow pressure to be modulated; and wherein each thrust cup of the one or more thrust cups is configured to receive a flow of fluid at the first axial end of the thrust cup, and to at least partially block the fluid from flowing axially past the second axial end of the thrust cup.

15. The multi-diameter thrust device of claim 14, further comprising a wheel arrangement connected to the one or more thrust cups, wherein the wheel arrangement is configured with a wheel with an exterior diameter that is configured to contact an interior diameter of a wellbore prior to a portion of the plurality of bowsprings.

16. The multi-diameter thrust device according to claim 15, wherein:

the multi-diameter thrust device further comprises:

an internal rod, wherein the internal rod is disposed within the mandrel and is coupled to the first axial end hub by way of a first mechanical connection, and wherein the internal rod and the first axial end hub are configured to translate along the mandrel;

the wheel arrangement is coupled to the internal rod such that when the interior diameter of the wellbore changes, the exterior diameter of the wheel is configured to change in accordance with the change in the interior diameter of the wellbore and translate the internal rod along the mandrel;

when the interior diameter of the wellbore gets smaller, the exterior diameter of the wheel gets smaller and the internal rod and the first axial end hub shift in a first direction, wherein the first direction is away from the second axial end hub; and when the interior diameter of the wellbore gets larger, the exterior diameter of the wheel gets larger and the internal rod and the first axial end hub shift in a second direction, wherein the second direction is towards the second axial end hub.

17. The multi-diameter thrust device according to claim 16, wherein the wheel arrangement further comprises:

an end hub;

a first support member, wherein the first support member is coupled to the wheel and the internal rod by way of a second mechanical connection such that when the exterior diameter of the wheel changes, the internal rod translates along the mandrel; and a second support member, wherein the second support member is coupled to the wheel and the end hub of the wheel arrangement by way of a third mechanical connection.

18. The multi-diameter thrust device of claim 14, wherein the relief valve arrangement is configured with a movable collar and a spring.

19. The multi-diameter thrust device of claim 18, wherein the relief valve arrangement is configured wherein the movable collar translates along an axis of the device.

* * * * *